US007922626B2

(12) United States Patent
Larson

(10) Patent No.: US 7,922,626 B2
(45) Date of Patent: Apr. 12, 2011

(54) EXERCISE APPARATUS HAVING A SURFACE FOR SLIDING

(76) Inventor: Cadmar Larson, Richmond (CA)

( * ) Notice: Subject to any disclaimer, the term of this patent is extended or adjusted under 35 U.S.C. 154(b) by 0 days.

(21) Appl. No.: 12/887,936

(22) Filed: Sep. 22, 2010

(65) Prior Publication Data

US 2011/0015044 A1 Jan. 20, 2011

Related U.S. Application Data

(60) Continuation of application No. 12/704,907, filed on Feb. 12, 2010, now Pat. No. 7,819,780, which is a division of application No. 12/404,126, filed on Mar. 13, 2009, now Pat. No. 7,686,741, which is a continuation-in-part of application No. 12/267,796, filed on Nov. 10, 2008, which is a continuation of application No. 11/594,913, filed on Nov. 9, 2006, now Pat. No. 7,470,219.

(60) Provisional application No. 60/737,749, filed on Nov. 18, 2005, provisional application No. 60/735,185, filed on Nov. 10, 2005.

(51) Int. Cl.
*A63B 22/02* (2006.01)
*A63B 69/18* (2006.01)

(52) U.S. Cl. ..... 482/54; 482/71

(58) Field of Classification Search ..... 482/51, 482/54, 61, 64–65, 69–71, 79–80, 114–115, 482/118–119, 121, 123, 133, 136–137, 142; 434/253; 280/818, 842; 198/860.1, 861.1; *A63B 22/02, 69/18*

See application file for complete search history.

(56) References Cited

U.S. PATENT DOCUMENTS

| | | | | |
|---|---|---|---|---|
| 3,420,385 | A * | 1/1969 | Verrinder | 414/792 |
| 3,834,693 | A | 9/1974 | Poppenberger | |
| 4,113,246 | A * | 9/1978 | Gibbs | 482/54 |
| 4,204,673 | A * | 5/1980 | Speer, Sr. | 482/5 |
| 4,274,625 | A * | 6/1981 | Gaetano | 482/54 |
| 4,340,214 | A * | 7/1982 | Schutzer | 482/51 |

(Continued)

FOREIGN PATENT DOCUMENTS

CA 1210787 9/1986

(Continued)

OTHER PUBLICATIONS

International Search Report for PCT/CA2006/001237, mailed Oct. 2, 2006.

(Continued)

*Primary Examiner* — Loan Thanh
*Assistant Examiner* — Oren Ginsberg
(74) *Attorney, Agent, or Firm* — Fasken Martineau DuMoulin LLP

(57) ABSTRACT

An exercise apparatus including: a pair of platforms, each of the pair of platforms having: a base including a lower surface and a pair of opposed flanges extending upwardly from the lower surface; roller units received side-by-side in the base and being independently rotatable, each of the roller units extending between the pair of opposed flanges of the base and including at least two roller bodies spaced from one another by a groove, each of the at least two roller bodies including an outer surface, at least a portion of the outer surface being in continuous contact with the lower surface of the base; a retainer coupled to the base for maintaining the rollers units on the base; and a connector for coupling the pair of platforms to one another to provide a surface for sliding.

10 Claims, 12 Drawing Sheets

U.S. PATENT DOCUMENTS

| | | | | | |
|---|---|---|---|---|---|
| 4,342,452 | A | * | 8/1982 | Summa | 482/54 |
| 4,595,195 | A | | 6/1986 | Miehlich | |
| 4,629,181 | A | | 12/1986 | Krive | |
| 4,781,372 | A | * | 11/1988 | McCormack | 482/70 |
| 5,385,520 | A | * | 1/1995 | Lepine et al. | 482/54 |
| 5,391,131 | A | | 2/1995 | Gordon | |
| 5,425,691 | A | | 6/1995 | Van Der Hoeven | |
| 5,509,870 | A | | 4/1996 | Lloyd | |
| 5,527,247 | A | * | 6/1996 | Archambault | 482/79 |
| 5,538,489 | A | | 7/1996 | Magid | |
| 5,749,811 | A | | 5/1998 | Wilson | |
| 6,010,432 | A | * | 1/2000 | Vawter | 482/54 |
| 6,042,511 | A | * | 3/2000 | Bulloch | 482/51 |
| 6,387,015 | B1 | | 5/2002 | Watson | |
| 6,893,382 | B1 | | 5/2005 | Moon et al. | |
| 7,160,231 | B2 | | 1/2007 | Kazemi | |
| 7,470,219 | B2 | * | 12/2008 | Larson | 482/54 |
| 7,686,741 | B2 | * | 3/2010 | Larson | 482/54 |
| 7,717,830 | B1 | * | 5/2010 | Charniga et al. | 482/54 |
| 7,819,780 | B2 | * | 10/2010 | Larson | 482/54 |
| 2004/0192515 | A1 | * | 9/2004 | Cane' | 482/54 |
| 2005/0209061 | A1 | | 9/2005 | Crawford et al. | |
| 2006/0205568 | A1 | | 9/2006 | Huang | |
| 2009/0118102 | A1 | * | 5/2009 | Larson | 482/51 |
| 2009/0176630 | A1 | | 7/2009 | Larson | |

FOREIGN PATENT DOCUMENTS

| | | |
|---|---|---|
| CA | 2157756 | 3/1996 |
| CA | 2466543 | 11/2005 |

OTHER PUBLICATIONS

Written Opinion of the International Searching Authority for PCT/CA2006/001237, mailed Oct. 2, 2006.

* cited by examiner

EXERCISE APPARATUS HAVING A SURFACE FOR SLIDING

RELATED APPLICATIONS

This application is a continuation of U.S. patent application Ser. No. 12/704,907 filed Feb. 12, 2010, which is a division of U.S. patent application Ser. No. 12/404,126 filed Mar. 13, 2009, which is a continuation-in-part of U.S. patent application Ser. No. 12/267,796 filed Nov. 10, 2008, which is a continuation of issued U.S. Pat. No. 7,470,219 filed Nov. 9, 2006, which claims the benefit of Provisional Patent Application No. 60/737,749 filed Nov. 18, 2005, and of Provisional Patent Application No. 60/735,185 filed Nov. 10, 2005, which are all incorporated by reference herein in their entirety.

TECHNICAL FIELD

The present invention relates to an exercise and training apparatus having a surface for sliding.

BACKGROUND

Ice skating, rollerblading and cross country skiing activities require similar types of controlled muscle movements for forward and rearward propulsion, for turning and for stopping. Successful execution and enjoyment of skating-type sports activities require the development of muscular agility, dexterity, strength and endurance. Hockey is a particularly demanding sports activity that requires bursts of forward and rearward propulsion, rapid twisting and squirming turns and stops. Of primary importance in executing these types of movements are the muscle groups controlling: (a) the orientation and positioning of the ankles for planting, aligning and adjusting foot position during execution of the planting and thrusting motions, during turns and stops, (b) the abduction and adduction (i.e., push-pull or extension/contraction) of the leg muscles during execution of planting, thrusting and turning motions, (c) hip girdle functions (i.e., twisting, sliding from side-to-side, bending forward and backward) to maintain body balance and weight transfer during the stride/glide sequences of propulsion, turning and stopping, and (d) upper body movements to complement and enhance the vigor of and/or control over the ankle, leg and hip muscle groups. While it is desirable for individuals participating in skating-type sports activities to train and exercise each of these muscle groups to improve their execution of the skating-type movements, it is of particular importance to develop the coordination and concurrent control of the above-noted multiple muscle groups distributed throughout the body.

Numerous types of training devices and exercise apparatus have been developed for focused training and strengthening exercises for stretching, sliding and skating type activities.

SUMMARY

In one aspect there is provided, a platform for an exercise apparatus, the platform comprising: a base including a lower surface and a pair of opposed flanges extending upwardly from the lower surface, one of the opposed flanges having a first flange portion and a second flange portion, the first flange portion being provided at an angle to the second flange portion; roller units received side-by-side in the base and being independently rotatable to define a surface for sliding, each of the roller units extending between the pair of opposed flanges of the base and including at least two roller bodies spaced from one another by a groove, each of the at least two roller bodies including an outer surface, the outer surface being in contact with the lower surface of the base; and a retainer coupled to the base for maintaining the roller units on the base; wherein the platform is for coupling to a second platform to provide the exercise apparatus.

In another aspect there is provided, an exercise apparatus including: a pair of platforms, each of the pair of platforms including: a base including a lower surface and a pair of opposed flanges extending upwardly from the lower surface; roller units received side-by-side in the base and being independently rotatable, each of the roller units extending between the pair of opposed flanges of the base and including at least two roller bodies spaced from one another by a groove, each of the at least two roller bodies including an outer surface, at least a portion of the outer surface being in continuous contact with the lower surface of the base; a retainer coupled to the base for maintaining the rollers units on the base; and a connector for coupling the pair of platforms to one another to provide a surface for sliding.

DRAWINGS

The following figures set forth embodiments of the invention in which like reference numerals denote like parts. Embodiments of the invention are illustrated by way of example and not by way of limitation in the accompanying figures.

Figure 2:
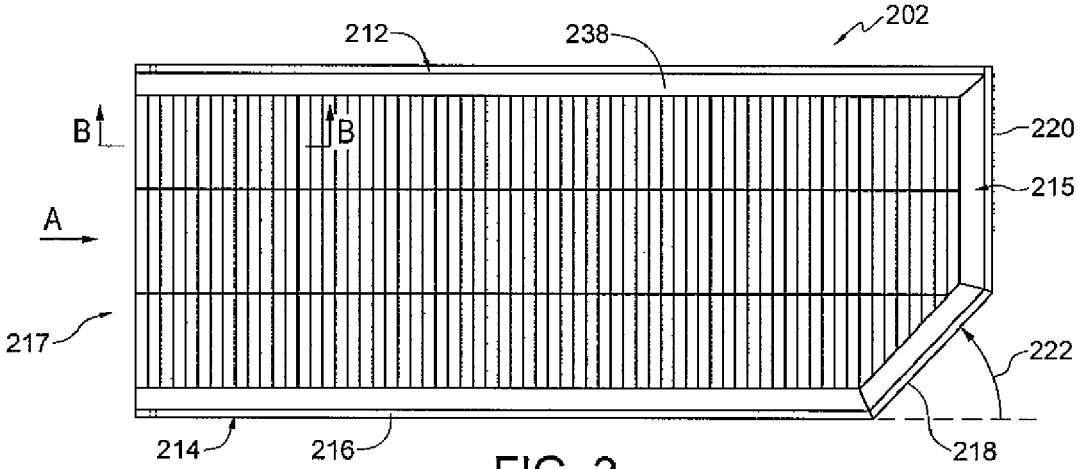
FIG. 2 is a top view of a platform of the exercise apparatus of FIG. 1 according to an embodiment.
Figure 19:
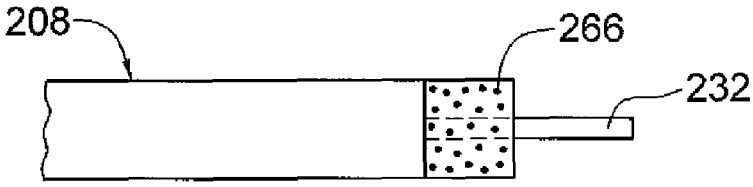
Figure 20:
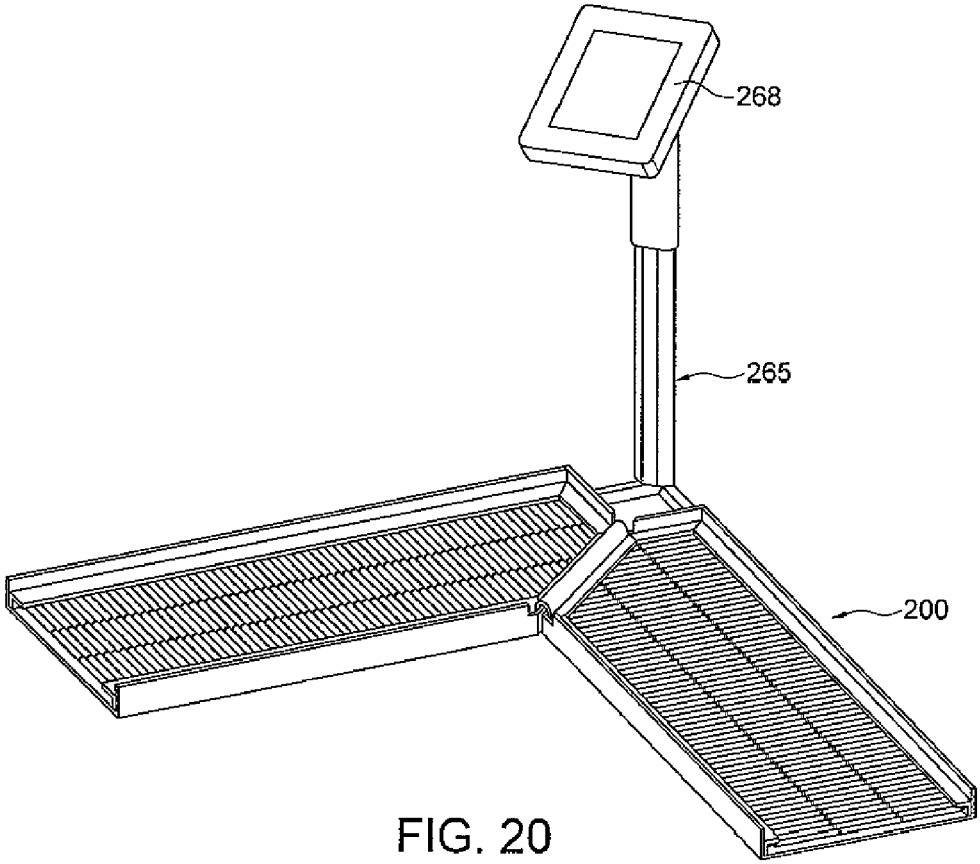
Figure 21:
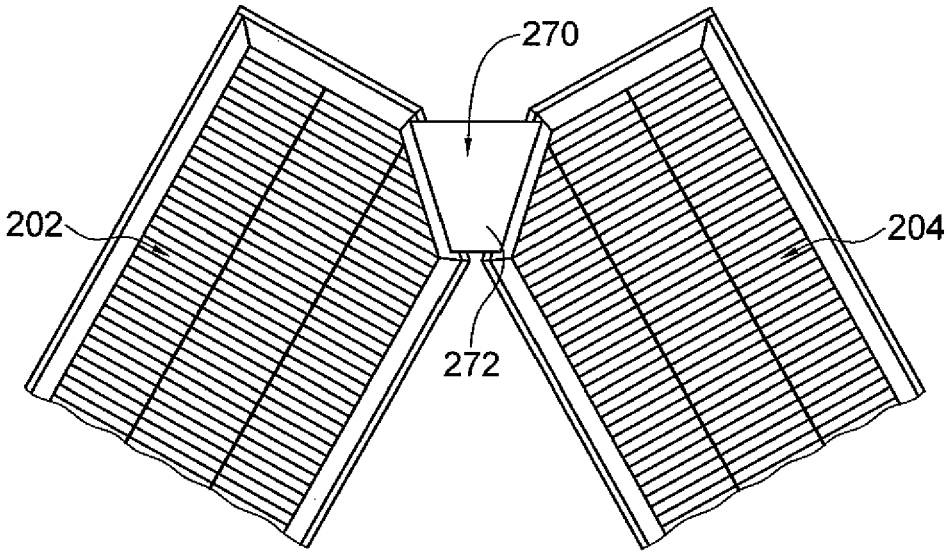
Figure 22:
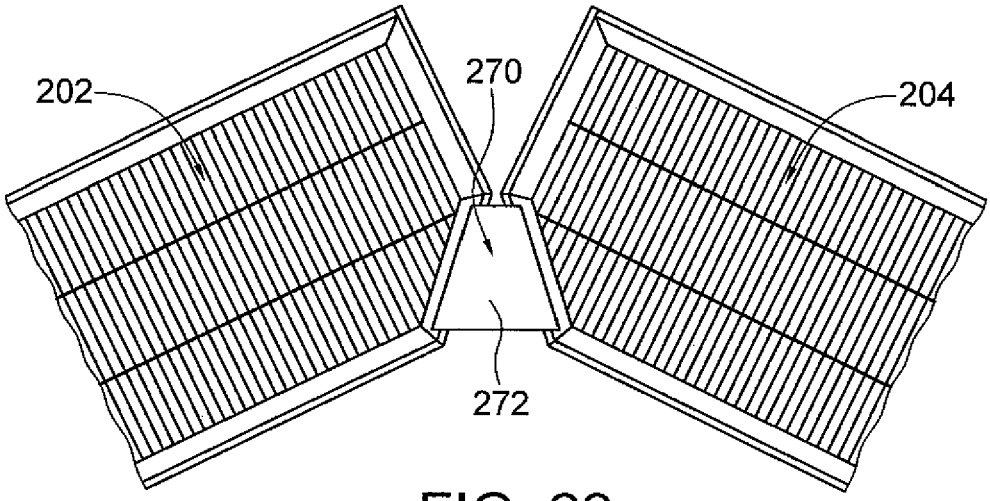
Figure 23:
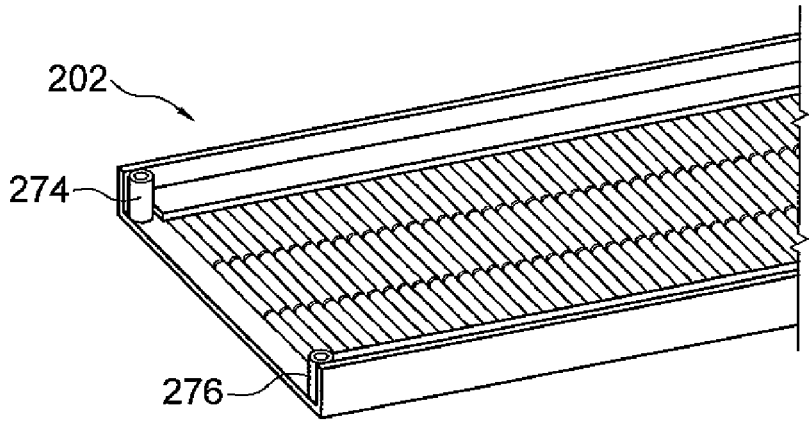
Figure 24:
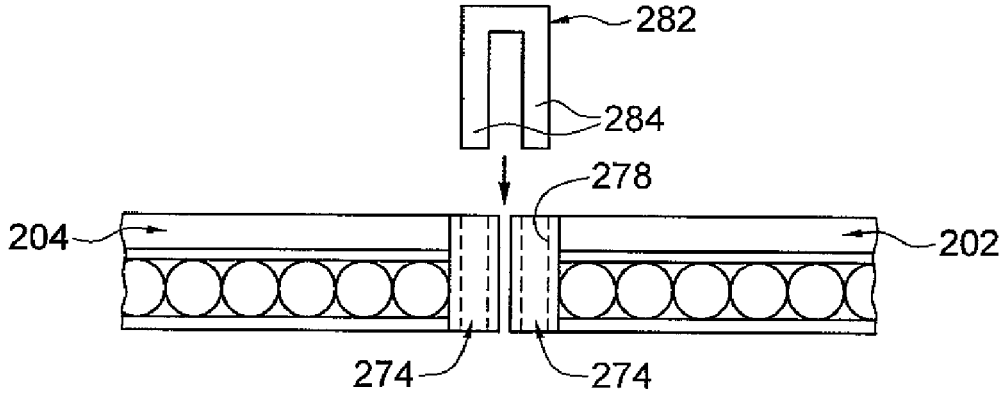
Figure 25:
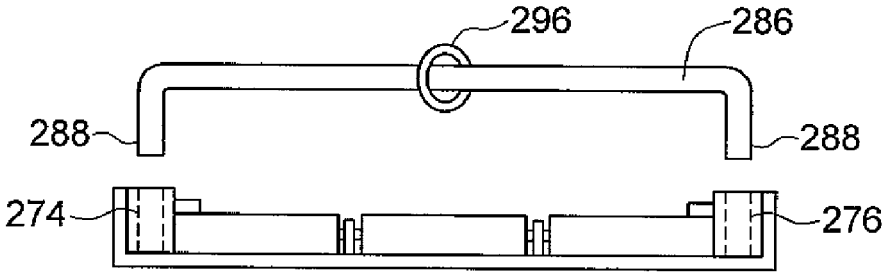

FIGS. 18(*a*) and 18(*b*) are views on A of FIG. 2 showing another embodiment;

FIG. 19 is a side view of a roller unit according to another embodiment;

FIG. 20 is an isometric view of an exercise apparatus according to another embodiment;

FIG. 21 is a top view of portions of an exercise apparatus according to another embodiment;

FIG. 22 is a top view of portions of an exercise apparatus according to yet another embodiment;

FIG. 23 is an isometric view of portions of a platform of an exercise apparatus according to another embodiment;

FIG. 24 is a sectional, partially exploded view of an exercise apparatus according to another embodiment; and FIG. 25 is an end, partially exploded, view of an exercise apparatus according to another embodiment.

DETAILED DESCRIPTION OF EMBODIMENTS OF THE INVENTION

Embodiments of the present invention provide an exercise apparatus including a pair of platforms that may be assembled in a first configuration to provide an exercise apparatus for skating-type activities or in a second configuration to provide an exercise apparatus for stretching and sliding activities. The skating-type activities allow users' major ankle, leg, hip and upper-body muscle groups involved in executing and controlling skating motions to be concurrently exercised and trained while the user remains generally fixed in place over the exercise apparatus. The stretching and sliding activities allow the user to flow between different poses while performing yoga or other stretching techniques and to perform slide board exercises, which include strength and coordination training exercises and goalie training exercises. The users may wear skating footgear, such as ice skates with or without skateguards, roller blades, or cross-country skis, for example, or other footwear, such as running shoes, soccer shoes, football shoes or baseball shoes, for example, or wear no footwear, while using the exercise apparatus for skating-type activities or stretching and sliding activities.

Figure 1:
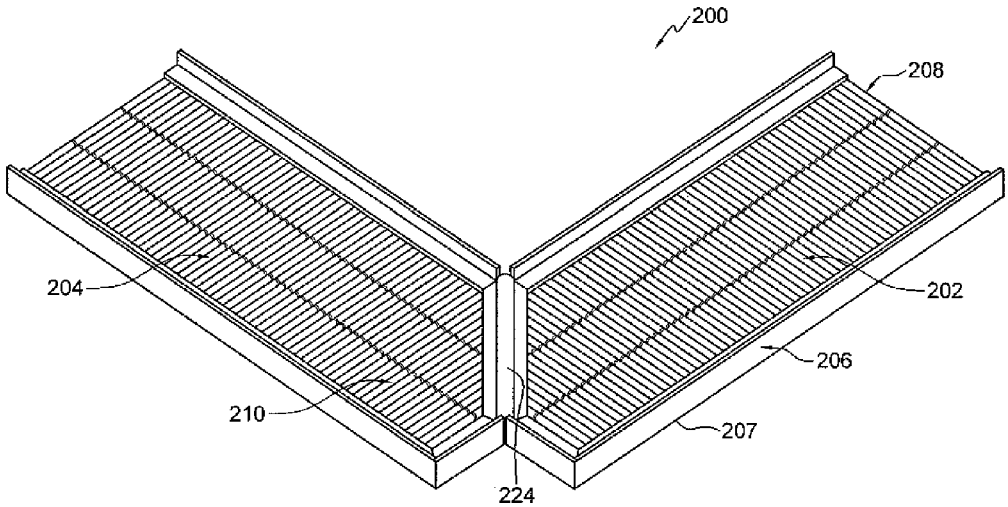
FIG. 1 is an isometric view of an exercise apparatus according to an embodiment.

Referring now to FIG. 1, an exercise apparatus 200 for skating-type activities is generally shown. The exercise apparatus 200 includes a pair of platforms 202, 204 that are coupled to one another. Each platform 202, 204 includes a plurality of roller units 208 that are received side-by-side on a lower surface 207 of a base 206. Together, the platforms 202, 204 provide a V-shaped surface for sliding 210 usable for performing skating-type activities.

Figure 3:
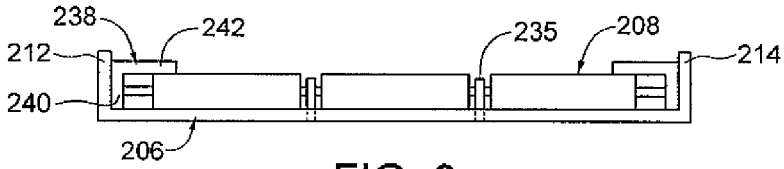
FIG. 3 is a view on A of FIG. 2.

Referring also to FIGS. 2 and 3, the base 206 of the platform 202 includes first and second opposed flanges 212 and 214, respectively, that extend upwardly therefrom. A third flange 220 extends between the first and second opposed flanges 212, 214 at a forward end 215 of the platform 202. The second opposed flange 214 includes a second flange portion 216, which is generally parallel to the first opposed flange 212, and a first flange portion 218, which is provided at an angle 222 to the second flange portion 216. The first flange portion 218 is provided at an angle 222 of between 10 degrees and 90 degrees from the second flange portion 216. In one embodiment, the angle 222 is 45 degrees.

Figure 6:
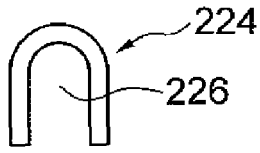
FIG. 6 is a sectional view of a connector of the exercise apparatus of FIG. 1.

Referring back to FIG. 1, the platform 204 is generally identical to the platform 202, however, is a mirror image thereof to allow the second flange portions 216 of the respective platforms 202, 204 to be coupled to one another to provide the V-shaped surface for sliding 210. The platforms 202, 204 are coupled to one another by a connector 224, which is shown in FIG. 6. The connector 224 includes a channel 226 for receiving the first flange portions 216 of the platforms 202, 204, when they are in abutment with one another. The channel 226 is sized to generally fix the platforms 202, 204 relative to one another during use of the exercise apparatus 200 while still allowing for easy installation and removal of the connector 224.

Where appropriate, embodiments of the present invention will be described in relation to platform 202 only and it will be understood by those skilled in the art that description of such embodiments applies similarly to the platform 204.

Figure 4:
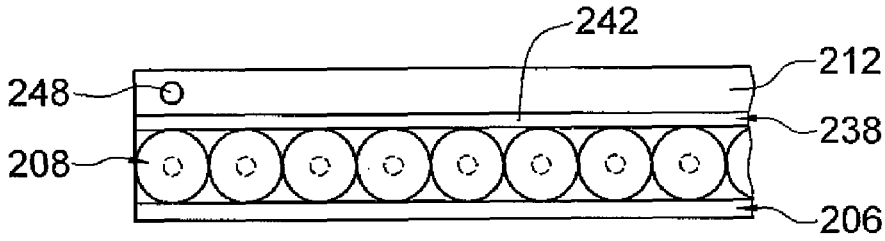
FIG. 4 is a view on B-B of FIG. 2.
Figure 5:
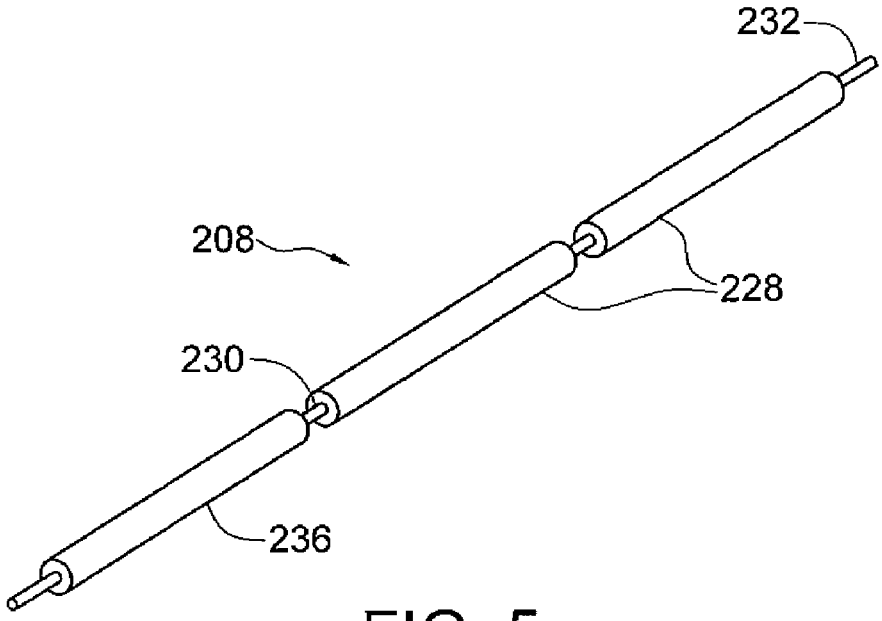
FIG. 5 is an isometric view of a roller unit of the exercise apparatus of FIG. 1.

As shown in FIGS. 1, 2 and 4, the roller units 208 are closely spaced and independently rotatable in both forward and rearward directions to provide a slippery surface suitable for use with ice skates, roller blades, cross-country skis or other footwear. Referring to FIG. 5, each roller unit 208 includes roller bodies 228 and spindles 232 that extend outwardly from ends 234 of the roller bodies 228. The spindles 232 are aligned with a rotation axis (not shown) of the roller unit 208. A groove 230 is provided between each adjacent pair of roller bodies 228. Each roller body 228 includes an outer surface 236 for contacting the base 206. The rollers units 208 are received between the opposed flanges 212, 214 and rest on the base 206, as shown in FIG. 3. The roller units 208 are provided in a side-by-side arrangement and are oriented so that the rotation axis is generally perpendicular to the first opposed flange 212. The roller units 228 that are located between the first flange portion 218 and the first opposed flange 212 are sized to fit in the tapered area defined thereby and therefore have a reduced length. As shown, some of the roller units 208 in the tapered area include one roller body 228 of reduced length and one of the roller units 208 includes two roller bodies 228.

Each roller unit 208 is injection molded as a single part. A diameter of the roller bodies 228 is sized between 0.5 and 1 inches and a diameter of the spindles is sized between ⅛ and 0.5 inches. In one embodiment, a diameter of the roller bodies 228 is ⅝ inches and a diameter of the spindles is ¼ inches.

The material of the roller units 208 is selected for its suitability for contacting and communicating with ice skate blades and cross-country skis. Such materials include: synthetic polymers, such as ultra-high molecular weight polyethylene (UHMW-PE), extruded polyvinylidene fluoride (PVDF) resins, extruded acetal copolymers and/or homopolymers, cast nylon 6 polymers, extruded nylon 6/6 polymers, Delrin™, for example, organic or inorganic nanocomposite materials, and natural or synthetic rubbers.

A retainer maintains the roller units 208 on the base 206. The retainer restricts "popping up" of the roller units 208 to generally keep the roller units 208 in contact with the lower surface 207 of the base 206 and restricts sliding of the roller units 208 relative to the base 206 in the direction of a rearward end 217 of the platform 202. Sliding of the roller units 208 relative to the base 206 in the direction of the forward end 215 of the platform 202 is restricted by the geometry of the tapered area, which is defined by the first flange portion 218 and the first opposed flange 212. The retainer may be a single part or more than one part.

As shown in FIGS. 2 and 3, bars 238 function as a first retainer to restrict "popping up" of the roller units 208 and clips 235 function as a second retainer to restrict sliding of the roller units 208 relative to the base 206. Three bars 238 are provided in contact with the roller bodies 228 of the roller units 208. Each bar 238 has a generally L-shaped cross-section and includes a flange-abutting portion 240 and a roller-abutting portion 242. The flange-abutting portions 240 of the bars 238 are coupled to one of: the first opposed flange 212, the second opposed flange 214 and the third flange 220. The roller-abutting portions 242 of the bars 238 are provided on top of the roller units 208 to maintain the roller units 208 in contact with the base 206 while allowing the roller units 208 to rotate. In order to minimize movement of the roller units 208 in the axial direction, a small clearance is provided between the spindles 232 and the flange-abutting portions 240 of the bars 238 that are coupled to the first opposed flange 212 and the second opposed flange 214. The roller units 208 may, alternatively, be sized so that no clearance is provided and the spindles 232 contact the flange-abutting portions 240 of the bars 238 while still allowing for rotation of the roller units 208.

The flange-abutting portions 240 of the bars 238 are coupled to the first opposed flange 212, the second opposed flange 214 and the third flange 220 by welding or suitable fasteners such as, bolts or rivets, for example. The bars 238 may alternatively be provided without the flange-abutting portion 240. In this embodiment, the bars 238 are generally flat and an edge of each bar is coupled to one of: the first opposed flange 212, the second opposed flange 214 and the third flange by welding or suitable fasteners. A small clearance is provided between the spindles 232 and the first and second opposed flanges 212, 214 to minimize movement of the roller units 208 in the axial direction.

The base 206 is made of aluminum and the bars 238 are made of a nylon plastic. The base 206 and bars 238 may alternatively be made from the same material. The base 206, the bars 236 or both may be made from any material having suitable strength properties such as plastic, titanium, or composite, for example. Material selection may further be based on material weight, noise reduction or friction characteristics.

Clips 235 are provided to couple the roller unit 208 that is located adjacent to the rearward end 217 of the platform 202 to the base 206. Each clip 235 is generally U-shaped and includes a pair of free ends (not shown). The clips 235 are received in the grooves 230 of the roller unit 208 and the free ends "snap" into apertures (not shown) of the lower surface 207 of the base 206. By securing the roller unit 208 that is located adjacent to the rearward end 217 of the platform 202, the other roller units 208 on the platform 202 are restricted from moving in the rearward direction 217. The clips 235 may be pieces of wire formed into U-shapes or another suitable material. In one embodiment, all of the roller units 208 are coupled to the base 206 using clips 235.

In another embodiment, the second retainer is a flange that is provided at the rearward end 217 of the platform 202. The flange is removable to allow for removal of the roller units 208 for maintenance or replacement purposes.

Figure 7:
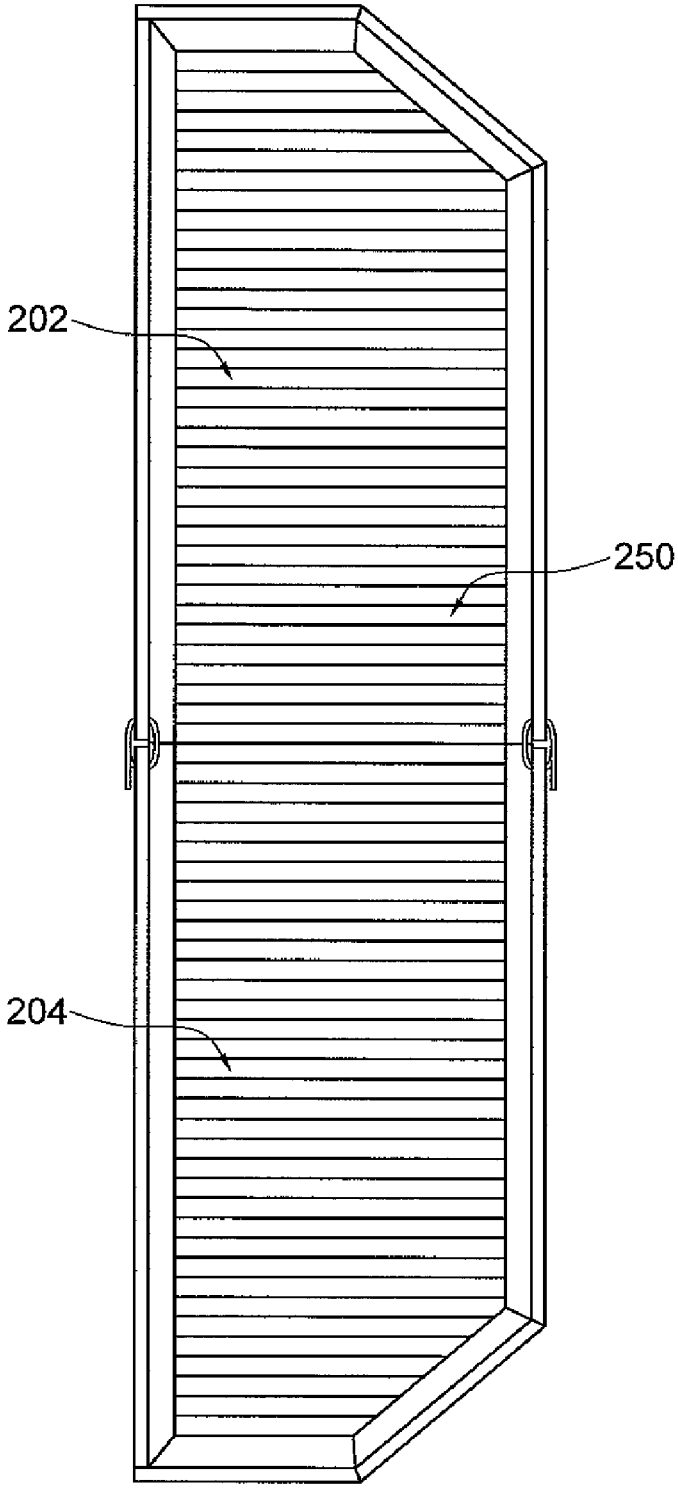
FIG. 7 is a top view of an exercise apparatus according to another embodiment.

Referring to FIG. 7, an exercise apparatus 300 for stretching and sliding activities is shown. In this embodiment, the rearward ends 217 of platforms 202 and 204 are coupled to one another in an end-to-end arrangement. Connecting straps 246 are threaded through adjacent apertures 248, which are shown in FIG. 4, of the platforms 202, 204. By coupling the platforms 202, 204 to one another as shown in FIG. 7, a single elongate surface for sliding 250 that is usable for performing stretching and sliding activities is provided. Stretching and sliding activities include: yoga, general stretching exercises and slide board exercises such as sliding lunges, sliding with deep knee bends, crossover exercises, balance and coordination exercises, stick handling exercises and goalie training exercises, for example.

In use, the platforms 202, 204 are coupled to one another to provide the exercise apparatus 200 of FIG. 1 or the exercise apparatus of FIG. 7. The user then performs a skating-type activity or a stretching or sliding activity, accordingly. If desired, the apparatus' 200, 300 may then be disassembled and stored, transported or re-assembled in a different configuration. The platforms 202, 204 are lightweight and may be transported individually or placed on top of one another and transported together. To further facilitate transport of the platforms 202, 204, castors may be provided at one end thereof.

Figure 8:
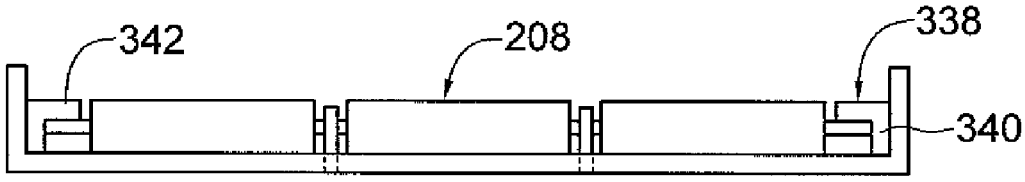
FIG. 8 is a view on A of FIG. 2 according to another embodiment.

Additional embodiments of the retainer of platform 202 will now be described with reference to FIGS. 8 to 12. Referring to FIG. 8, bars 338 of platform 202 include a flange abutting portion 340 and a spindle-abutting portion 342. The bars 338 are similar to bars 238 of the embodiment shown in FIG. 3, however, instead of abutting the roller bodies 228, the spindle-abutting portion 342 of each bar 338 abuts the spindles 232 of the roller units 208 to restrict "popping up" of the roller units 208. The bars 338 are used in combination with the second retainer to maintain the roller units 208 in contact with the base 206 while allowing the roller units 208 to rotate.

Figure 9:
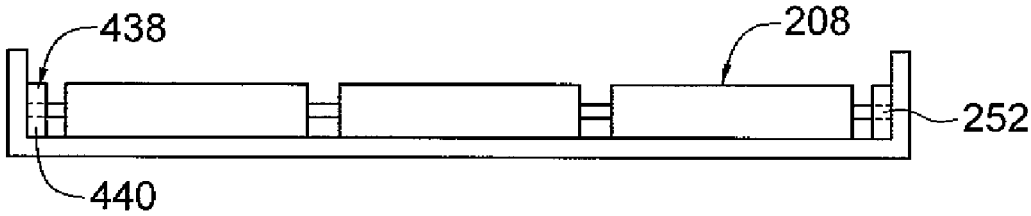
FIG. 9 is a view on A of FIG. 2 according to yet another embodiment.

Another embodiment is shown in FIG. 9. In this embodiment, bars 438 of platform 202 include a flange-abutting portion 440 that includes a series of bores 252 for receiving the spindles 232 of the roller units 208. The bores 252 are located and sized to maintain the roller units 208 in contact with the base 206 and minimize movement of the roller units 208 in the axial direction. It will be appreciated by a person skilled in the art that the bores 252 may extend entirely through the bars 438 or, alternatively, may extend part-way through the bars 438. In this embodiment, the bars 438 function to maintain each roller units 208 in position on the base 206 and restrict the roller units 208 from "popping up". Thus, the bars 438 function as a single retainer.

Figure 10:
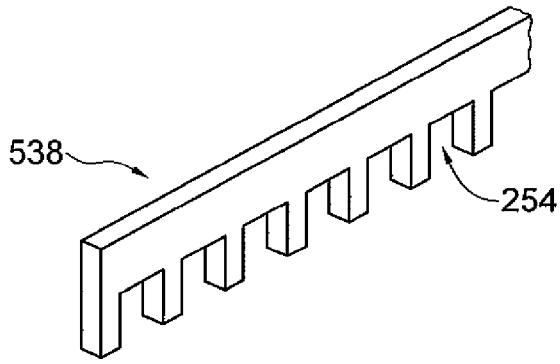
FIG. 10 is an isometric view of a bar of the platform of FIG. 2 according to an embodiment.
Figure 11:
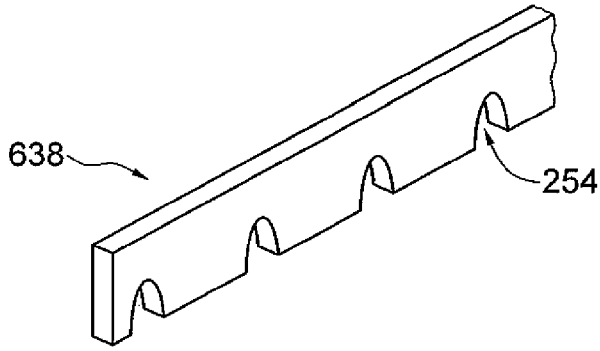
FIG. 11 is an isometric view of a bar of the platform of FIG. 2 according to another embodiment.

Other embodiments are shown in FIGS. 10 and 11. In these embodiments, bars 538 and 638, respectively, are similar to bar 438 of FIG. 9, however, instead of bores 252, cutouts 254 are provided. The cutouts are sized for receiving the spindles 232 to maintain the roller units 208 in contact with the base 206 and minimize movement of the roller units 208 in the axial direction. As shown, the cutouts 254 of FIG. 10 are generally rectangular and the cutouts 254 of FIG. 11 are curved.

Figure 12:
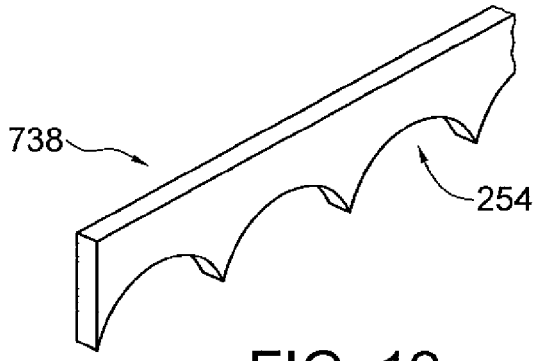
FIG. 12 is an isometric view of a bar of the platform of FIG. 2 according to yet another embodiment.

Another embodiment is shown in FIG. 12. In this embodiment, bars 738 are similar to bars 538 and 638 of FIGS. 10 and 11, however, cutouts 254 are sized for receiving the roller bodies 228 of the roller units 208. The bars 738 function in a similar manner as the embodiments of FIGS. 8 to 11 to maintain the roller units 208 in contact with the base 206 and minimize movement of the roller units 208 in the axial direction. It will be appreciated by a person skilled in the art that, similar to the embodiment of FIG. 9, the bars of FIGS. 10, 11 and 12 functions as a single retainer.

In another embodiment, a gap is provided between the cutouts 254 of the bars 738 of FIG. 12 and the roller bodies 228. This provides a non-level surface for sliding and allows the roller units 208 to "pop up" or "pop down" in response to contact with the user's foot, which simulates the feel of ice by providing an "edge". In addition, the user will experience resistance because the foot will press against the roller units 208 rather than gliding across a flat surface.

For users having advanced skill, strength and endurance levels, it is desirable to apply resistance to the rollers units 208 in order to cause the users to exert more effort and force while using the exercise apparatus 200, 300. Embodiments showing resistance applied to the roller units 208 are provided in FIGS. 13 to 18.

Figure 13:
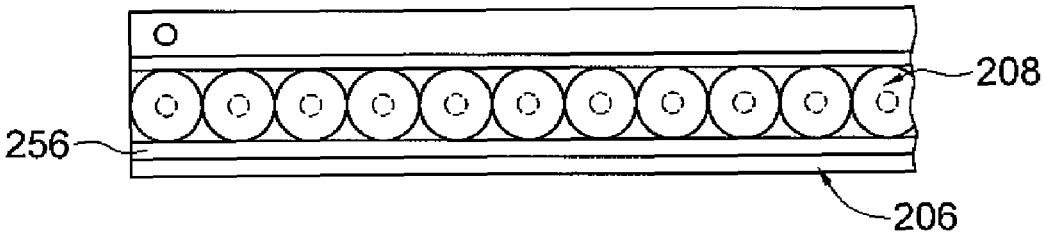
FIG. 13 is a view on B-B of FIG. 2 according to another embodiment.

Referring to FIG. 13, a pad 256 is provided between the roller units 208 and the base 206. In use, the pad 256 deforms when force is applied to the roller units 208 by the user. This deformation causes an increased surface area of the pad 256 to be in contact with the roller bodies 228, which results in resistance being applied to the roller units 208. In addition, when a first roller unit 208 is pressed downward by a user's foot, the next roller is slightly above the first roller unit 208 to simulate the "edge" effect of skating.

The pad 256 is made of pure gum rubber or another resilient material such as a natural or synthetic rubber, for example. After extended use, the roller bodies 228 may have a reduced diameter resulting from contact with skate blades. The pad 256, therefore, is adjustable upwards from the base 206 to maintain contact with the roller bodies 228. The pad 256 may be adjusted by inserting a spacer to move the pad 256 into contact with the roller bodies 228 or the pad 256 may be replaced with a thicker material. It will be appreciated that the pad 256 may be provided in multiple pieces or as a single piece.

Figure 14:
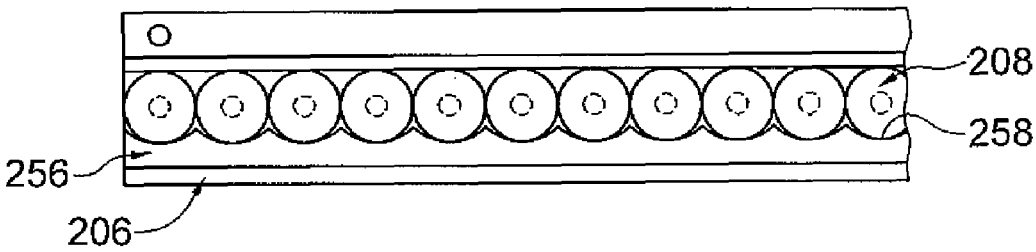
FIG. 14 is a view on B-B of FIG. 2 according to yet another embodiment.

Referring to FIG. 14, pad 256 includes indentations 258 that are sized for receiving the roller bodies 228. This embodiment operates in a similar manner to the embodiment of FIG. 13, however, provides constant spacing between the roller units 208. The indentations 258 further add resistance to the roller units 208 because the surface area of the pad 256 that is in contact with the roller bodies 228 both before and after deformation is increased.

Figure 15:
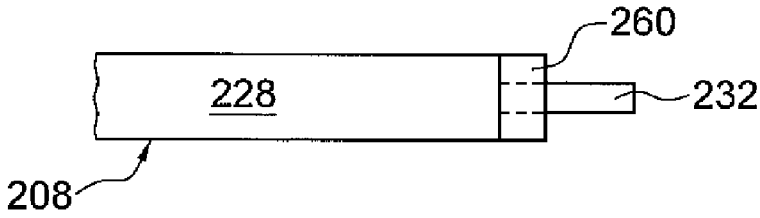
FIG. 15 is a side view of a roller unit according to another embodiment.

Referring to FIG. 15, resilient caps 260 are mounted on spindles 232 of the roller units 208. The resilient caps 260 are rotatable with the spindles 232 and are sized to be in contact with the base 206. In use, the resilient caps 260 deform when force is applied to the roller units 208 by the user. This provides increased friction between the base 206 and each resilient cap 260, thus resulting in resistance being applied to the roller units 208. The resilient caps 260 are made of a resilient material such as natural rubber, synthetic rubber, styrene butadiene rubber (SBR), nitrile butadiene rubber (NBR), acrylic butal styrene (ABS) or any other suitable material.

The resilient caps 260 may alternatively have a smaller diameter than the roller bodies 228 and be sized to contact the bars 538, 638 and 738 of the embodiments shown in FIGS. 10, 11 and 12, respectively. This allows the user to customize the amount of resistance that is applied to each roller unit 208.

The caps 260 may alternatively have a larger diameter that the roller bodies 228 and be staggered in order to provide clearance between adjacent caps 260. This embodiment is typically used in combination with pad 256 so that the roller units 208 are not subjected to bending. This embodiment allows the user to fine tune the resistance being applied to the roller units 208.

The caps 260 may be provided with a smooth outer surface or cog teeth that are sized to communicate with cog teeth of adjacent caps 260. In this embodiment, roller units 208 are able to move adjacent roller units 208. One or more roller units 208 may be motorized in order to impart resistance on the other roller units 208. Alternatively, the caps 206 may include a circumferential groove provided in an outer surface thereof for receiving a continuous belt. Resistance would be applied to the caps 260 by the continuous belt and would be adjustable manually or electrically.

Figure 16:
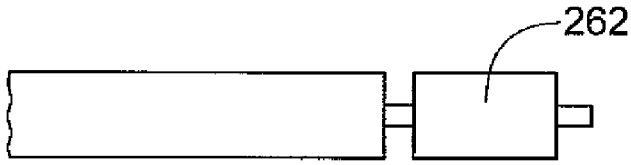
FIG. 16 is a side view of a roller unit according to another embodiment.

Referring to FIG. 16, weighted caps 262 are mounted on spindles 232 of the roller units 208. The weighted caps 262 add resistance due to the added weight. The weighted caps 262 are made of steel, however, may alternatively be made of another metal or heavy material. When the weighted caps 262 are made of a magnetic metal, magnetic resistance may also be applied to the roller units 208.

Figure 17:
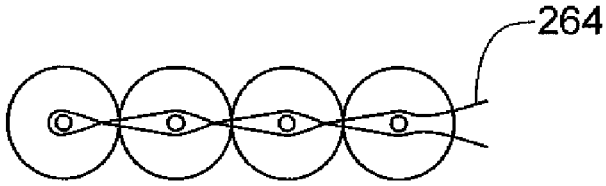
FIG. 17 is an end view of roller units according to another embodiment.

Referring to FIG. 17, an elastic cord 264 is looped around the spindles 232 to provide resistance to the roller units 208.

Figure 18A:
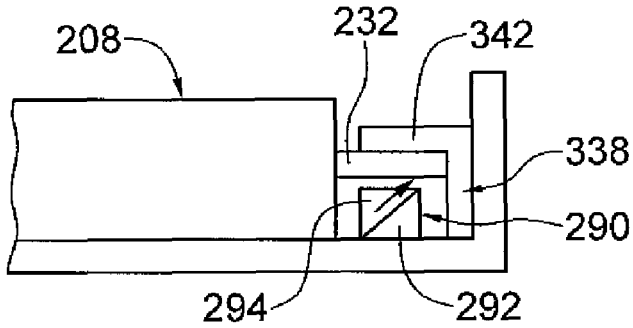
Figure 18B:
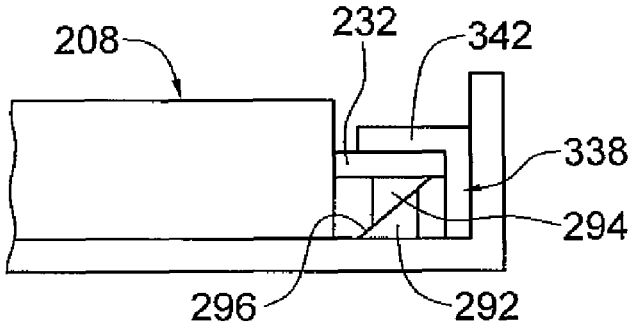

Resistance may also be added by applying a compressive force to the spindles 232 of the roller units 208. Referring to FIGS. 18*a* and 18*b*, a resistance assembly 290 includes a fixed bar 292 and a movable bar 294. The movable bar 294 is slidable along a contact surface 296 of the fixed bar 292 between the positions shown in FIGS. 18(*a*) and 18(*b*) to apply a compressive force on the spindles 232. The compressive forces pinches the spindles 232 between the spindle-abutting flange 342 of the bar 338 and the movable bar 294 to apply resistance to the roller units 208. A lever (not shown) is actuated to move the movable bar 294. The level is lockable to maintain the movable bar 294 in a desired position.

In another embodiment, a wire 244 wraps around the roller units 208 to couple the roller units 208 to one another and provide a roller unit assembly. The wire 244 is received in the grooves 230 of the roller units 208 and is made of a galvanized steel or any other suitable material. The wire 244 is sized to generally fill the grooves 230 so that, in use, skate blades do not slip into the grooves 230. In addition, the wire 244 reduces the occurrence of skate blades being caught between adjacent roller units 208. The wire 244 can further function as a resistance mechanism by tightening the wire 244 around the roller units 208.

Over time, the roller units 208 wear down and need to be replaced. Some of the factors that affect the life of each roller unit 208 are: the frequency of use of the exercise apparatus, the location of the roller unit 208 on the platform 202, 204 and the type of footwear worn by the user. In order to function as a wear indicator, the wire 244 is coated with paint, plastic or another suitable coating. When the roller unit 208 has been worn down, skate blades, for example, scrape the wire in contact with the worn roller unit 208 and remove the coating to indicate to the user that the roller unit 208 needs replacement.

For embodiments that do not include resistance or embodiments that apply resistance using methods other than inclusion of the deformable pad 256, it may be desirable to minimize the resistance between the roller bodies 228 and the lower surface 207 of the base 206. This may be achieved by including a pad 256 that is made of Delrin™ or another material having a low-friction surface. In this embodiment, the pad 256 is not deformable but instead provides a slippery surface so that rotation of the roller bodies 228 is not impeded by the pad 256. Similarly, the lower surface 207 of the base 206 may be made of Delrin™ or another material having a low-friction surface.

It may be desirable to provide feedback to the user of the apparatus' 200, 300 during exercise. FIG. 19 shows another embodiment in which LED lights are provided within a clear plastic housing 266. The LED lights are illuminated when the roller unit 208, to which the plastic housing 266 is attached, rotates. Battery powered LED lights within plastic housing 266 are commercially available and are currently used for rollerblades hockey bags, shoes and yo-yos, for example. In addition, audible feedback may be provided to the user. In this embodiment, sounds or music is played when the roller units 208 are rotated.

Referring now to FIG. 20, another embodiment including a chest pad 268 that is coupled to a support rail 265 is shown. During a skating-type activity, the user is able to rest on the chest pad 268, which functions to align the user's chest at the proper angle for skating of between 60 and 65 degrees. The user may also use the chest pad 268 as a hand rail for balance purposes. In one embodiment, a ring (not shown) is coupled to the support rail 265. The ring allows for attachment of rubber tubing or exercise equipment for coupling to the user while the exercise apparatus is being used. When using the apparatus for skating-type activities, the rubber tubing may be attached to each of the user's legs to provide additional resistance.

Referring to FIGS. 21 and 22, additional embodiments of the exercise apparatus 200 are shown. The embodiments shown include a connector 270 that couples the platforms 202 and 204 together. The connector 270 may be installed to provide the platforms 202, 204 at an acute angle with respect to one another, as shown in FIG. 21, or alternatively, the connector 270 may be installed to provide the platforms 202, 204 at an obtuse angle with respect to one another, as shown in FIG. 22. The connector 270 includes a plate 272 having a pair of channels (not shown) that are provided in a lower surface thereof. The channels are sized to receive the first flange portions 218 of the platforms 202, 204 and are provided at an angle of approximately 30 degrees relative to one another. The connector 270 is made of nylon plastic. The connector 270 may alternatively be made of another rigid material such as ABS or steel, for example, in order to maintain the platforms 202, 204 in position during use. It will be appreciated by a person skilled in the art that the connector 270 may include channels provided at different angles relative to one another. Any angle that provides the V-shaped surface for sliding 210 may be used.

In another embodiment, the first flange portion 218 is provided in line with the second flange portion 216 so that the platforms 202, 204 are rectangular and generally identical. In this embodiment, a connector similar to the connector of FIGS. 21 and 22 is provided to couple the platforms together at an angle to one another to provide the V-shaped surface for sliding 210.

Referring to FIGS. 23 and 24, another embodiment for coupling the platforms 202, 204 to one another in an end-to-end arrangement is shown. Cylinders 274 and 276 are fixed to the base 206 of the platforms 202, 204. The cylinders 274, 276 include apertures 278 for receiving ends 284 of a U-shaped connector 282, as shown in FIG. 24. Two connectors 282 are provided to couple the platforms to one another; a first connector couples cylinders 274 of the platforms to one another and a second connector couples cylinders 276 of the platforms to one another.

Another embodiment is shown in FIG. 25, in which a U-shaped bar 286 having ends 288 is sized to be received in cylinders 274 and 276 of each platform 202, 204. One U-shaped bar 286 is provided at the rearward end 217 of each platform 202, 204 and includes a ring 296 to allow for attachment of rubber tubing or exercise equipment that is coupled to the user while the exercise apparatus is being used. When using the apparatus 200 for skating-type activities, the rubber tubing may be attached to each of the user's legs to provide additional resistance.

It will be appreciated by a person skilled in the art that the platforms 202, 204 may be provided with any length, width or shape. For example, wider platforms 202, 204 may be desirable to accommodate full length cross country skis. In addition, the base 206 may be any suitable shape, such as oval, for example. Further, the platforms 202, 204 may be coupled to one another in configurations other than those shown in the figures. For example, the platforms 202, 204 may be arranged side-by-side and used for walking or running activities.

In order to facilitate transportation of the platforms 202, 204, each platform 202, 204 may optionally be provided with a hinge and be foldable along a width thereof. In this embodiment, the platforms 202, 204 would be provided with handles that allow each platform 202, 204 to be carried in a similar manner as a suitcase.

The roller unit assembly, which includes the roller units 208 coupled to one another by the wire 244, may alternatively be rolled up for transportation. In this embodiment, the roller unit assembly is coupled to a slip-resistant mat, such as a pad 256 or a yoga mat, for example, and may be used with or without the base 206. Clips 235 may be provided to couple the roller unit assembly to the mat and function as a retainer. Hook and loop fasteners, such as Velcro™ fasteners, for example, may be provided at various locations on the base 206, the roller unit assembly and the mat to couple the roller unit assembly and mat to the base 206.

When not being used with the base 206, the roller unit assembly and mat may be placed on the floor. To couple the roller unit assemblies and mats to one another to provide the surface for sliding 210 for skating-type activities and the surface for sliding 250 for stretching and sliding activities, Velcro™ fasteners, for example, may be provided. Each roller assembly and mat may be rolled up as a unit and placed in a bag for transport. A canvas or nylon cover may be included to cover the mat and protect the mat from wear resulting from transport and contact with the floor. The cover may further be formed to cover the spindles 232 of the roller units 208 and have the ability to form a bag when rolled up with the roller unit assembly and mat.

It may be desirable to provide performance-related information associated with the exercise activity to the user. Such information may be used to monitor performance, set performance goals, and record performance parameters. The embodiments for providing performance-related information will be described with respect to skating-type activities that are performed using the exercise apparatus 200 of FIG. 1.

In one embodiment, a sensor (not shown) is provided in communication with the roller units 208. The sensor is a piezoelectric vibration transducer that is coupled to the bar 238. Output from the piezoelectric vibration transducer is wirelessly transmitted to a computer (not shown) that includes an output device (not shown) such as a display or a printer, for example. The computer generates and outputs a graph based on signals received from the piezoelectric vibration transducer. The graph is a representation of movement of the roller units 208 resulting from user-applied force. The output from the piezoelectric vibration transducer may alternatively be used to provide audio output. In this embodiment, the user is able to modify the stride length or applied force to produce a variety of different sounds.

In another embodiment, sensors are coupled to each of the spindles 232 to detect the rotational speed of the roller units 208 and force applied to each roller unit 208. The sensors transmit signals wirelessly to the computer. The computer uses the data received from the sensors to provide performance output that may be displayed on the display screen or output to a printer including: stride length, applied force, speed, recovery time between strides, toe flick at the end of the stride which corresponds to the second push of a stride, endurance, conditioning time from the beginning of a training session as compared to the end of the training session, work to rest ratio, force at a particular point in the stride, weight transfer, timing of weight transfer during the stride and other performance parameters. In addition, surface electromyography sensors may be used to provide data relating to fast-twitch and slow-twitch muscles and biochemical muscle composition.

In another embodiment, the exercise apparatus 200 is an input device for an interactive video game. In this embodiment, sensors are coupled to the exercise apparatus and provided in communication with a processor of the interactive video game console to provide a computer simulation of the user performing an activity on the exercise apparatus 200 on a display screen. Optionally, the user is able to compete against a computer-generated competitor that is displayed on a display screen. The computer-generated competitor may correspond to another user who is skating on another exercise apparatus or may be a computer programmed simulation. As the user performs the activity, the sensors transmit performance data, in the form of signals, to the video game console. The video game console uses the performance data to modify the computer-generated simulation in approximately real-time. Input devices for interactive video games are well known in the art and therefore will not be described further here. The exercise apparatus 200, 300 may be provided as an input device for video game consoles such as the Wii™ manufactured by Nintendo™.

The embodiments including sensors for detecting performance-related information have been described as providing wireless signal transmission. It will be appreciated by a person skilled in the art that the signal transmission may alternatively be provided through a wired connection. It will further be appreciated that the sensors for detecting performance-related information may be used in conjunction with sensors for monitoring vital statistics, such as heart rate monitors, for example.

Specific embodiments have been shown and described herein. However, modifications and variations may occur to those skilled in the art. All such modifications and variations are believed to be within the scope and sphere of the present invention.

The invention claimed is:

1. An exercise apparatus comprising:

a pair of platforms, each of said pair of platforms including:

a base including a lower surface and first and second opposed flanges extending upwardly from said lower surface;

roller units received side-by-side in said base and being independently rotatable, each of said roller units extending between said first and second opposed flanges of said base and including at least two roller bodies spaced from one another by a groove, each of said at least two roller bodies including an outer surface, at least a portion of said outer surface being in continuous contact with said lower surface of said base;

a retainer coupled to said base for maintaining said rollers units on said base; and a connector for selectively coupling said first opposed flange of one of the pair of platforms to said second opposed flange of another one of the pair of platforms at an angle between said platforms to provide a V-shaped surface for sliding.

2. An exercise apparatus as claimed in claim 1, wherein said connector couples said platforms to one another at an acute angle in a first orientation of said connector and said connector couples said platforms to one another at an obtuse angle in a second orientation of said connector.

3. An exercise apparatus as claimed in claim 1, wherein said connector comprises a plate having two channels, each channel engaging a corresponding flange.

4. An exercise apparatus as claimed in claim 3, wherein the two channels are at said angle to each other.

5. An exercise apparatus as claimed in claim 1, wherein said connector comprises a plate having a plurality of channels arranged at a plurality of angles relative to each other, each channel adapted to engage a corresponding flange to hold the pair of platforms at a selectable angle of said plurality of angles.

6. An exercise apparatus comprising:

a pair of platforms, each of said pair of platforms including:

a base including a lower surface and a pair of opposed flanges extending upwardly from said lower surface, one of said opposed flanges having a first flange portion and a second flange portion, said first flange portion being provided at an angle to said second flange portion;

roller units received side-by-side in said base and being independently rotatable, each of said roller units extending between said pair of opposed flanges of said base and including at least two roller bodies spaced from one another by a groove, each of said at least two roller bodies including an outer surface, at least a portion of said outer surface being in continuous contact with said lower surface of said base;

a retainer coupled to said base for maintaining said rollers units on said base; and a connector for selectively coupling said first flange portions of said pair of platforms to one another at an angle between said first flange portions to provide a V-shaped surface for sliding.

7. An exercise apparatus as claimed in claim 6, wherein said connector couples the first flange portions of said platforms to one another at an acute angle between said first flange portions in a first orientation of said connector and said connector couples the first flange portions of said platforms to one another at an obtuse angle between said first flange portions in a second orientation of said connector.

8. An exercise apparatus as claimed in claim 6, wherein said connector comprises a plate having two channels, each channel engaging a corresponding first flange portion.

9. An exercise apparatus as claimed in claim 8, wherein the two channels are at said angle to each other.

10. An exercise apparatus as claimed in claim 6, wherein said connector comprises a plate having a plurality of channels arranged at a plurality of angles relative to each other, each channel adapted to engage a corresponding first flange portion to hold the pair of platforms at a selectable angle of said plurality of angles.

* * * * *